US008881500B2

(12) United States Patent
Gutmark et al.

(10) Patent No.: US 8,881,500 B2
(45) Date of Patent: Nov. 11, 2014

(54) DUPLEX TAB OBSTACLES FOR ENHANCEMENT OF DEFLAGRATION-TO-DETONATION TRANSITION

(75) Inventors: Ephraim Jeff Gutmark, Cincinnati, OH (US); Aaron Jerome Glaser, Niskayuna, NY (US); Adam Rasheed, Glenville, NY (US)

(73) Assignee: General Electric Company, Niskayuna, NY (US)

( * ) Notice: Subject to any disclaimer, the term of this patent is extended or adjusted under 35 U.S.C. 154(b) by 408 days.

(21) Appl. No.: 12/872,693

(22) Filed: Aug. 31, 2010

(65) Prior Publication Data

US 2012/0047873 A1 Mar. 1, 2012

(51) Int. Cl.

| | |
|---|---|
| ***F02C 5/00*** | (2006.01) |
| ***F23M 9/06*** | (2006.01) |
| ***F23R 7/00*** | (2006.01) |
| ***F23R 3/16*** | (2006.01) |
| ***F23C 15/00*** | (2006.01) |

(52) U.S. Cl.

CPC .. *F23R 7/00* (2013.01); *F23M 9/06* (2013.01); *F23R 3/16* (2013.01); *F23C 15/00* (2013.01)

USPC ..... 60/247; 60/39.38; 60/39.76; 60/752

(58) Field of Classification Search

USPC ..... 60/39.38, 39.76, 247, 752, 753, 754, 60/755, 756, 757, 758, 759, 760

See application file for complete search history.

(56) References Cited

U.S. PATENT DOCUMENTS

| | | | | |
|---|---|---|---|---|
| 3,557,830 | A * | 1/1971 | Raw | 137/896 |
| 4,164,375 | A * | 8/1979 | Allen | 366/337 |
| 5,361,828 | A * | 11/1994 | Lee et al. | 165/109.1 |
| 5,433,596 | A * | 7/1995 | Dobbeling et al. | 431/350 |
| 5,513,982 | A * | 5/1996 | Althaus et al. | 431/350 |
| 5,791,405 | A * | 8/1998 | Takiura et al. | 165/184 |
| 5,797,726 | A * | 8/1998 | Lee | 416/96 R |
| 5,803,602 | A * | 9/1998 | Eroglu et al. | 366/337 |
| 6,135,629 | A * | 10/2000 | Dohmann | 366/181.5 |
| 6,578,627 | B1 * | 6/2003 | Liu et al. | 165/109.1 |
| 6,877,310 | B2 | 4/2005 | Leyva | |
| 6,896,509 | B2 * | 5/2005 | Carroni et al. | 431/9 |
| 6,929,058 | B2 * | 8/2005 | Liu et al. | 165/80.3 |
| 7,367,194 | B2 | 5/2008 | Murayama et al. | |
| 7,373,778 | B2 * | 5/2008 | Bunker et al. | 60/752 |
| 7,520,124 | B2 * | 4/2009 | Narayanan et al. | 60/262 |
| 7,669,405 | B2 | 3/2010 | Pinard et al. | |
| 8,683,780 | B2 * | 4/2014 | Shimo et al. | 60/247 |
| 2001/0052411 | A1 * | 12/2001 | Pantow et al. | 165/152 |
| 2004/0037162 | A1 * | 2/2004 | Flohr et al. | 366/181.5 |
| 2006/0016582 | A1 * | 1/2006 | Hashimoto et al. | 165/109.1 |
| 2007/0180810 | A1 * | 8/2007 | Chapin et al. | 60/39.76 |
| 2009/0320486 | A1 | 12/2009 | Gutmark et al. | |

* cited by examiner

*Primary Examiner* — Gerald L Sung
*Assistant Examiner* — Michael B Mantyla
(74) *Attorney, Agent, or Firm* — Scott J. Asmus

(57) ABSTRACT

A detonation chamber for a pulse detonation combustor including: a plurality of duplex tab obstacles disposed on at least a portion of an inner surface of the detonation chamber wherein the plurality of duplex tab obstacles enhance a turbulence of a fluid flow through the detonation chamber.

20 Claims, 6 Drawing Sheets

DUPLEX TAB OBSTACLES FOR ENHANCEMENT OF DEFLAGRATION-TO-DETONATION TRANSITION

BACKGROUND

The present disclosure generally relates to cyclic pulsed detonation combustors (PDCs) and more particularly, the enhanced mixing and turbulence levels of the fuel-air mixture and flame kernel in order to promote the deflagration-to-detonation transition (DDT) process.

In a generalized pulse detonation combustor, fuel and oxidizer (e.g., oxygen-containing gas such as air) are admitted to an elongated combustion chamber at an upstream inlet end. An igniter is used to initiate this combustion process. Following a successful transition to detonation, a detonation wave propagates toward the outlet at supersonic speed causing substantial combustion of the fuel/air mixture before the mixture can be substantially driven from the outlet. The result of the combustion is to rapidly elevate pressure within the combustor before substantial gas can escape through the combustor exit. The effect of this inertial confinement is to produce near constant volume combustion. Such devices can be used to produce pure thrust or can be integrated in a gas-turbine engine. The former is generally termed a pure thrust-producing device and the latter is termed a pulse detonation turbine engine. A pure thrust-producing device is often used in a subsonic or supersonic propulsion vehicle system such as rockets, missiles and afterburner of a turbojet engine. Industrial gas turbines are often used to provide output power to drive an electrical generator or motor. Other types of gas turbines may be used as aircraft engines, on-site and supplemental power generators, and for other applications.

The deflagration-to-detonation process begins when a fuel-air mixture in a chamber is ignited via a spark or other source. The subsonic flame generated from the spark accelerates as it travels along the length of the chamber due to various chemical and flow mechanics. As the flame reaches critical speeds, "hot spots" are created that create localized explosions, eventually transitioning the flame to a super sonic detonation wave. The DDT process can take up to several meters of the length of the chamber, and efforts have been made to reduce the distance required for DDT by using internal obstacles in the flow. The problem with obstacles for cyclic detonation devices is that they have relatively high pressure drop, and require cooling. Shaped-wall features, which reduce run-up to detonation that are integrated with the wall for cooling and have low-pressure drops, are desirable.

As used herein, a "pulse detonation combustor" is understood to mean any device or system that produces pressure rise, temperature rise and velocity increase from a series of repeating detonations or quasi-detonations within the device. A "quasi-detonation" is a supersonic turbulent combustion process that produces pressure rise, temperature rise and velocity increase higher than pressure rise, temperature rise and velocity increase produced by a deflagration wave. Embodiments of pulse detonation combustors include a fuel injection system, an oxidizer flow system, a means of igniting a fuel/oxidizer mixture, and a detonation chamber, in which pressure wave fronts initiated by the ignition process coalesce to produce a detonation wave or quasi-detonation. Each detonation or quasi-detonation is initiated either by external ignition, such as spark discharge or laser pulse, or by gas dynamic processes, such as shock focusing, autoignition or by another detonation (cross-fire). As used herein, a detonation is understood to mean either a detonation or quasi-detonation. The geometry of the detonation combustor is such that the pressure rise of the detonation wave expels combustion products out the pulse detonation combustor exhaust to produce a thrust force. Pulse detonation combustion can be accomplished in a number of types of detonation chambers, including shock tubes, resonating detonation cavities and tubular/tuboannular/annular combustors. As used herein, the term "chamber" includes pipes having circular or non-circular cross-sections with constant or varying cross sectional area. Exemplary chambers include cylindrical tubes, as well as tubes having polygonal cross-sections, for example hexagonal tubes.

BRIEF SUMMARY

Briefly, in accordance with one embodiment, a detonation chamber for a pulse detonation combustor is provided. The detonation chamber includes a plurality of duplex tab obstacles disposed on at least a portion of an inner surface of the detonation chamber. The duplex tab obstacles are further configured enhance a turbulence of a fluid flow and flame acceleration through the detonation chamber.

In accordance with another embodiment, a detonation chamber for a pulse detonation combustor is provided. The detonation chamber includes a plurality of duplex tab obstacles disposed on at least a portion of an inner surface of the detonation chamber. The plurality of duplex tab obstacles are configured having compound radial and circumferential inclination therein to enhance a turbulence of a fluid flow and flame acceleration through the detonation chamber. Each of the plurality of duplex tab obstacles includes at least a pair of tabs. The detonation chamber further includes an inlet and an outlet. The plurality of duplex tab obstacles are disposed on at least a portion of an inner surface of the detonation chamber between the inlet and the outlet.

In accordance with another embodiment, a pulse detonation combustor is provided. The pulse detonation combustor includes at least one detonation chamber; an oxidizer supply section for feeding an oxidizer into the detonation chamber; a fuel supply section for feeding a fuel into the detonation chamber; and an igniter for igniting a mixture of the gas and the fuel in the detonation chamber. The detonation chamber comprises a plurality of duplex tab obstacles disposed on an inner surface of the detonation chamber. The plurality of duplex tab obstacles are provided to enhance a turbulence of a fluid flow and flame acceleration through the detonation chamber.

BRIEF DESCRIPTION OF THE DRAWINGS

Referring to the exemplary drawings wherein like elements are numbered alike in the several Figures.

DETAILED DESCRIPTION

Figure 1:
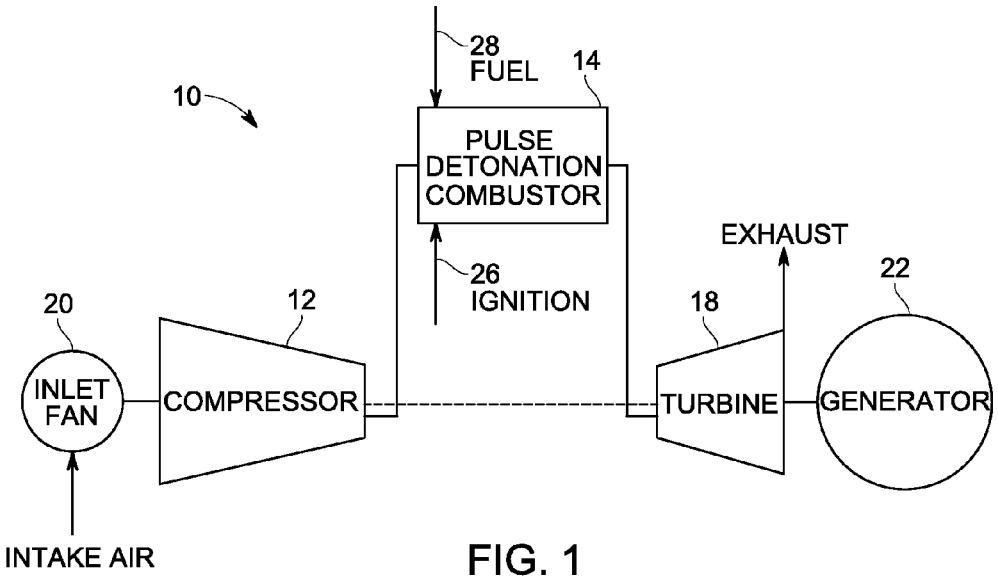
FIG. 1 (PRIOR ART)
FIG. 1 is a schematic view illustrating a structure of a hybrid pulse detonation turbine engine system.
Figure 2:
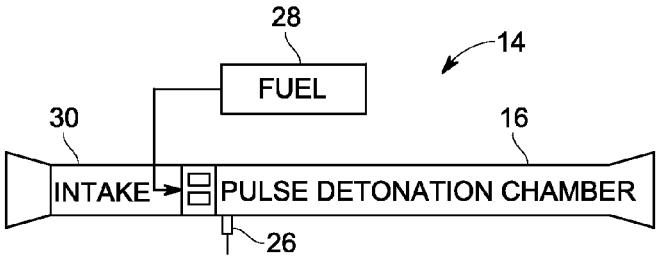
FIG. 2 (PRIOR ART)
FIG. 2 is a schematic view illustrating a structure of a single combustion chamber of the pulse detonation combustor of FIG. 1.

Referring now to FIGS. 1 and 2, various pulse detonation engine systems 10 convert kinetic and thermal energy of the exhausting combustion products into motive power necessary for propulsion and/or generating electric power. Illustrated in FIG. 1 is an exemplary embodiment of a pulse detonation combustor 14 in a pulse detonation turbine engine concept 10. Illustrated in FIG. 2 is an exemplary embodiment of a pulse detonation combustor 14 in a pure supersonic propulsion vehicle. The pulse detonation combustor 14, shown in FIG. 1 or FIG. 2, includes a detonation chamber 16 having an oxidizer supply section (e.g., an air intake) 30 for feeding an oxidizer (e.g., oxidant such as air) into the detonation chamber 16, a fuel supply section (e.g., a fuel valve) 28 for feeding a fuel into the detonation chamber 16, and an igniter (for instance, a spark plug) 26 by which a mixture of oxidizer combined with the fuel in the detonation chamber 16 is ignited.

In exemplary embodiments, air supplied from an inlet fan 20 and/or a compressor 12, which is driven by a turbine 18, is fed into the detonation chamber 16 through an intake 30. Fresh air is filled in the detonation chamber 16, after purging combustion gases remaining in the detonation chamber 16 due to detonation of the fuel-air mixture from the previous cycle. After the purging the pulse detonation combustor 16, fresh fuel is injected into pulse detonation combustor 16. Next, the igniter 26 ignites the fuel-air mixture forming a flame, which accelerates down the pulse detonation chamber 16, finally transitioning to a detonation wave or a quasi-detonation wave. Due to the detonation combustion heat release, the gases exiting the pulse detonation combustor 14 are at high temperature, high pressure and high velocity conditions, which expand across the turbine 18, located at the downstream of the pulse detonation combustor 16, thus generating positive work. For the pulse detonation turbine engine application with the purpose of generation of power, the pulse detonation driven turbine 18 is mechanically coupled to a generator (e.g., a power generator) 22 for generating power output. For a pulse detonation turbine engine application with the purpose of propulsion (such as the present aircraft engines), the turbine shaft is coupled to the inlet fan 20 and the compressor 12. In a pure pulse detonation engine application of the pulse detonation combustor 14 shown in FIG. 2, which does not contain any rotating parts such as a fan or compressor/turbine/generator, the kinetic energy of the combustion products and the pressure forces acting on the walls of the propulsion system, generate the propulsion force to propel the system.

Figure 3:
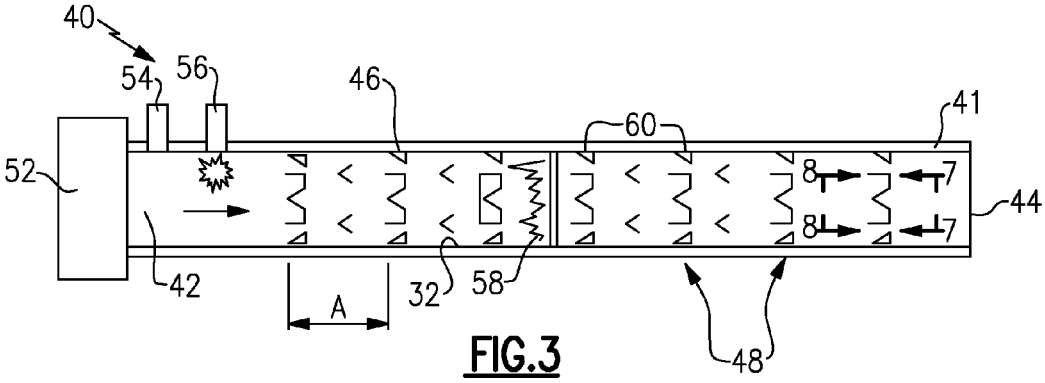
FIG. 3 is a diagram illustrating an improved pulse detonation combustor including duplex tab obstacles for deflagration-to-detonation transition enhancement in accordance with exemplary embodiments.
Figure 4:
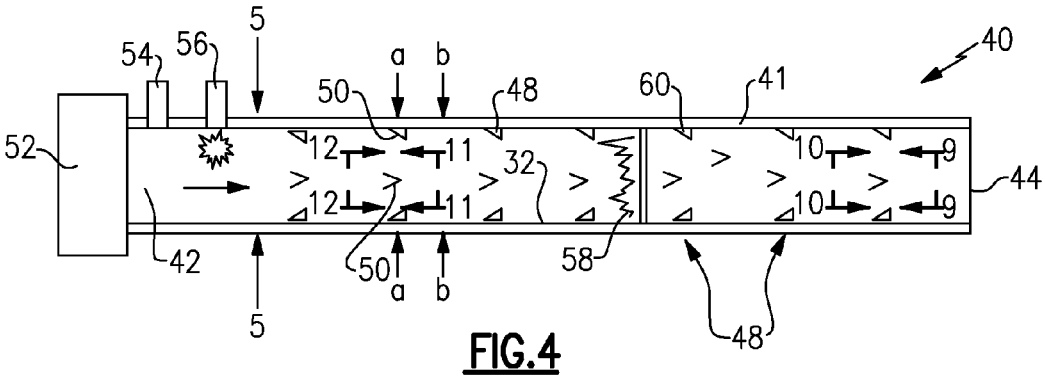
FIG. 4 is a diagram illustrating an improved pulse detonation combustor including duplex tab obstacles for deflagration-to-detonation transition enhancement in accordance with exemplary embodiments.

Turnings now to FIGS. 3 and 4, illustrated are schematic views of alternate embodiments of an improved pulse detonation combustor, generally depicted as 40, similar to pulse detonation combustor 14 of FIGS. 1 and 2. The schematic views illustrate an inside of an improved pulse detonation chamber 41, generally similar to pulse detonation chamber 16 of FIG. 2, by removing the top 50% of the chamber, or tube, surface. More specifically, illustrated are embodiments of the improved pulse detonation combustor 40, including the pulse detonation chamber 41, having a plurality of duplex tab obstacles for deflagration-to-detonation transition. The improved pulse detonation chamber 41 includes an inlet 42 and an outlet 44, through which a fluid flows from upstream towards downstream, as indicated by the directional arrows. The improved pulse detonation chamber 41 also includes a plurality of duplex tab obstacles 46, 50 also referred to as delta vortex generating duplex tab obstacles, as best illustrated in FIG. 3, or alternatively, a plurality of duplex tab obstacles 48, 50 also referred to as mushroom vortex generating duplex tab obstacles, as best illustrated in FIG. 4. The duplex tab obstacles 46, 48, 50 may be disposed on an inner surface 32 of the improved detonation chamber 41 and extend into the detonation chamber 41. The pulse detonation combustor 40 may further include proximate the inlet 42 of the pulse detonation chamber 41, an air intake valve 52, a fuel intake 54 and an ignition source 56.

The plurality of duplex tab obstacles 46, 48, 50 on the inner surface 32 of the improved detonation chamber 41 enhance the turbulent flame speed, and accelerate the turbulent flame, while limiting the total pressure loss in the pulse detonation combustor 40. The plurality of duplex tab obstacles 46, 48, 50 also enhance turbulence flame surface area by providing more volume, into which the flame can expand, compared to the flame surface area in a combustor chamber with smooth walls. Contrary to protrusions that constrict the flow, the plurality of duplex tab obstacles 46, 48, 50 can potentially result in a smaller pressure loss while generating the same levels of flame acceleration. A plurality of circumferentially and axially spaced apart duplex tab obstacles 46, 48, 50 were found to be necessary in the illustrated embodiments to affect the transition of the accelerating turbulent flame into a detonation wave 58.

The plurality of duplex tab obstacles 46, 48, 50 may be arranged as depicted in the embodiments illustrated in FIGS. 3 and 4. In exemplary embodiments, the plurality of duplex tab obstacles 46, 48, 50 may be disposed in a number of rows and columns as depicted in FIGS. 3 and 4, circumferentially spaced with the columns being spaced axially along the improved pulse detonation chamber 41, and the rows being spaced circumferentially along the improved pulse detonation chamber 41. Additionally, the number of rows and columns and the spacing between each may be varied to achieve detonations or quasi-detonations in varying fuel-air systems. In other exemplary embodiments, the plurality of duplex tab obstacles may be disposed in a number of rows and columns with the duplex tab obstacles having staggered or inline arrangement along the axial direction. In further exemplary embodiments, the plurality of duplex tab obstacles may have varying density of obstacles on the interior surface of the pulse detonation chamber. In the exemplary embodiments illustrated in FIGS. 3 and 4, the duplex tab obstacles 46, 48, 50 are disposed in one or more circumferential arrays 60, each including a plurality of duplex tab obstacles 46, 48, 50 wherein each circumferential array 60 is axially spaced as indicated at "A", relative to another circumferential array 60, along at least a portion of the inner surface 32 of the detonation chamber 41 from the inlet 42 to the outlet 44.

Referring still to FIGS. 3 and 4, the plurality of duplex tab obstacles 46, 48, 50 may be disposed in a wide variety of arrangements on the inner surface 32 of the pulse detonation chamber 41, between the inlet 42 and the outlet 44. In an exemplary embodiment, the duplex tab obstacles 46, 48, 50 are arranged in corresponding rows in the pulse detonation chamber 41 in single planes along a length of the pulse detonation chamber 41.

Figure 5:
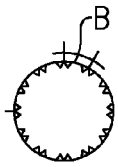
FIG. 5 is a schematic cross-section view taken along line 5-5 of FIG. 4 of an improved pulse detonation combustor including duplex tab obstacles for deflagration-to-detonation transition enhancement in accordance with exemplary embodiments.

Referring now to FIG. 5, illustrated is a simplified cross-section view of the pulse detonation chamber 41 taken along line 5-5 of FIG. 4. The plurality of duplex tab obstacles 48 (46, 50) within each circumferential array 60 are circumferentially spaced apart from each other at a circumferential spacing "B", which may be conveniently measured from center of each duplex tab obstacle 46, 48 to a center of an adjacent duplex tab obstacle 46, 48, 50 that may vary from 24 to 180 degrees. In an exemplary embodiment the plurality of duplex tab obstacles 46, 48, 50 are circumferentially spaced, by approximately 30 degrees. In the embodiments illustrated in FIGS. 3 and 4, the duplex tab obstacles 46, 48, 50 respectively, are preferably equiangularly spaced apart at the center-to-center circumferential spacing "B" in corresponding obstacles around the inner surface 32 of the pulse detonation chamber 41.

Figure 6A:
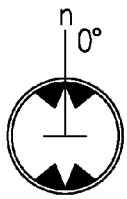
FIGS. 6*a* and 6*b* are schematic cross-section views taken along lines a-a and b-b of FIG. 4, respectively, illustrating relative clock angles between circumferential arrays of duplex tab obstacles for deflagration-to-detonation transition enhancement in accordance with exemplary embodiments.
Figure 6B:
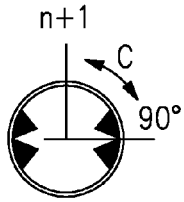

In addition, as best illustrated in FIG. 6*a*, taken along line a-a of FIG. 4, and FIG. 6*b*, taken along line b-b of FIG. 4, each circumferential array 60 has a clocking angle "C" relative to another circumferential array 60 that may vary between 0-90 degrees. In an exemplary embodiment the plurality of circumferential arrays 60 are circumferentially spaced relative to one another, by approximately 90 degrees.

Referring now to FIGS. 7-12, as previously indicated, the pulse detonation chamber 41 may be modified to include deflagration-to-detonation transition enhancing features in the form of duplex tab obstacles 46, 48, 50 for generating counter-rotating vortices. The duplex tab obstacles 46, 48, 50 may have compound radial and circumferential downstream inclination therein for generating pairs of streamwise counter-rotating vortices to enhance the turbulent flame speed, and accelerate the turbulent flame, and more specifically the detonation wave 58, with minimal pressure losses in the pulse detonation chamber 41 which would otherwise decrease efficiency and performance.

Exemplary embodiments of the duplex tab obstacles 46, 48, 50 are illustrated for the improved pulse detonation chamber 41 and have similar features as described separately hereinbelow.

Figure 7:
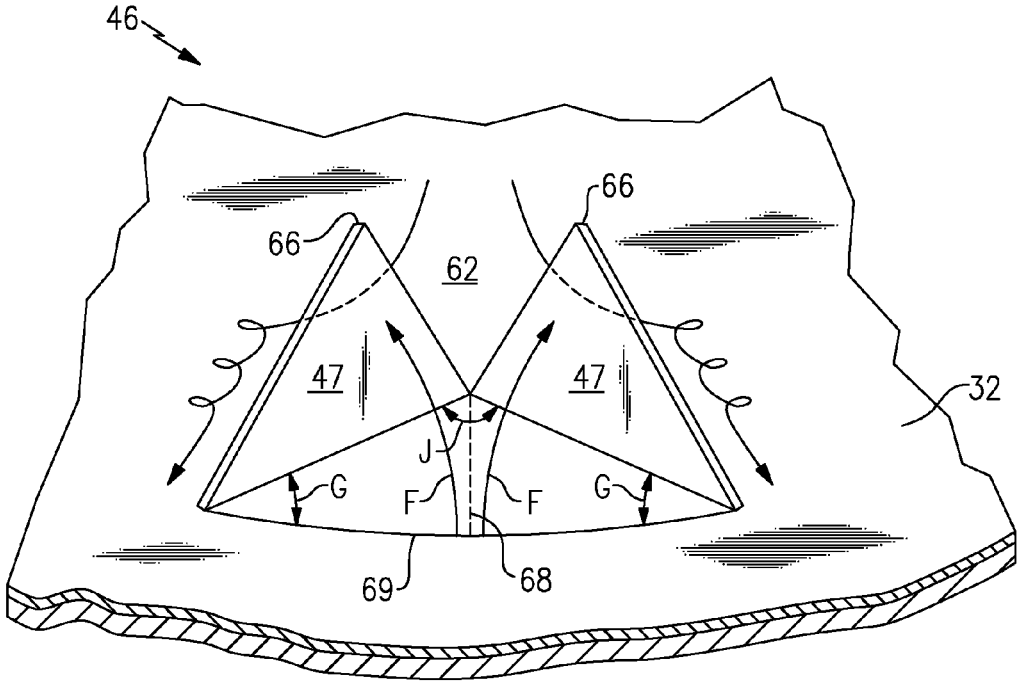
FIG. 7 is an upstream elevational view taken along line 7-7 of FIG. 3 illustrating an exemplary delta vortex generating duplex tab obstacle mounted in the improved pulse detonation combustor.
Figure 8:
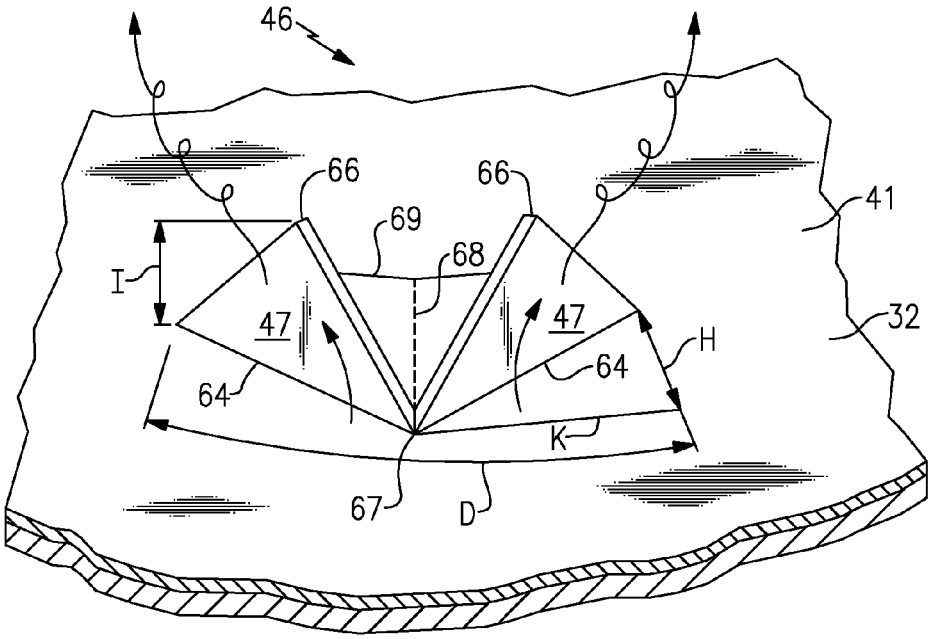
FIG. 8 is a downstream elevational view taken along line 8-8 of FIG. 3, illustrating an exemplary delta vortex generating duplex tab obstacle mounted in the improved pulse detonation combustor.

In the embodiment illustrated in FIGS. 7 and 8, a delta vortex generating duplex tab obstacle is described. More specifically, as illustrated in FIGS. 7 and 8, the duplex tab obstacles 46 (of which only one is illustrated) are substantially identical with each other and arranged circumferentially spaced apart, with each duplex tab obstacle 46 having a common center slot 62 circumferentially therebetween a pair of adjacent tab members 47. The pair of tab members 47 of each duplex tab obstacle 46 circumferentially adjoin each other at the inner surface 32 of the pulse detonation chamber 41, with the common center slot 62 extending radially inwardly from the common junction thereof.

Figure 9:
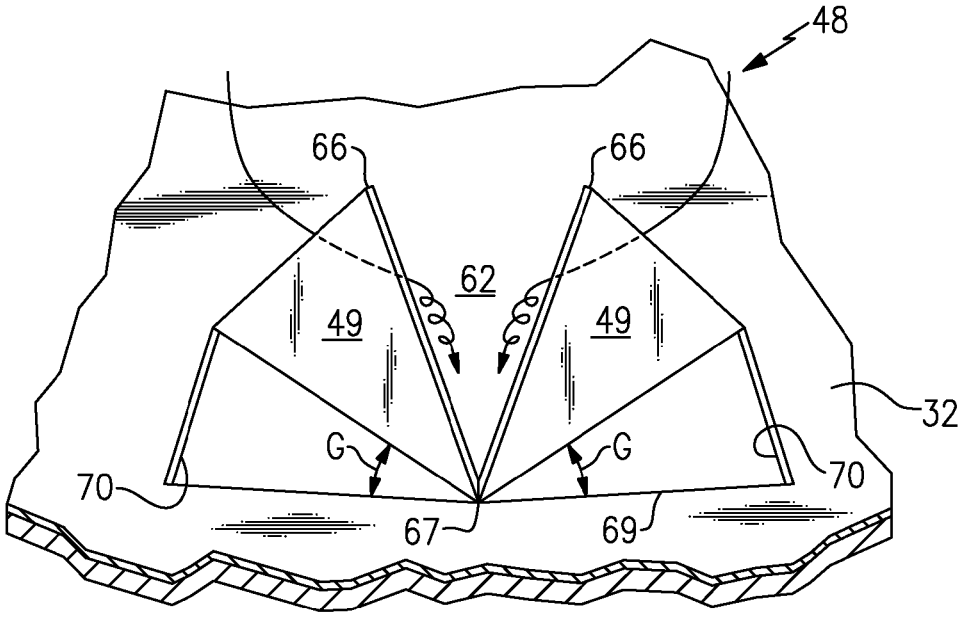
FIG. 9 is an upstream elevational view taken along line 9-9 of FIG. 4, illustrating an exemplary mushroom vortex generating duplex tab obstacle mounted in the improved pulse detonation combustor.
Figure 10:
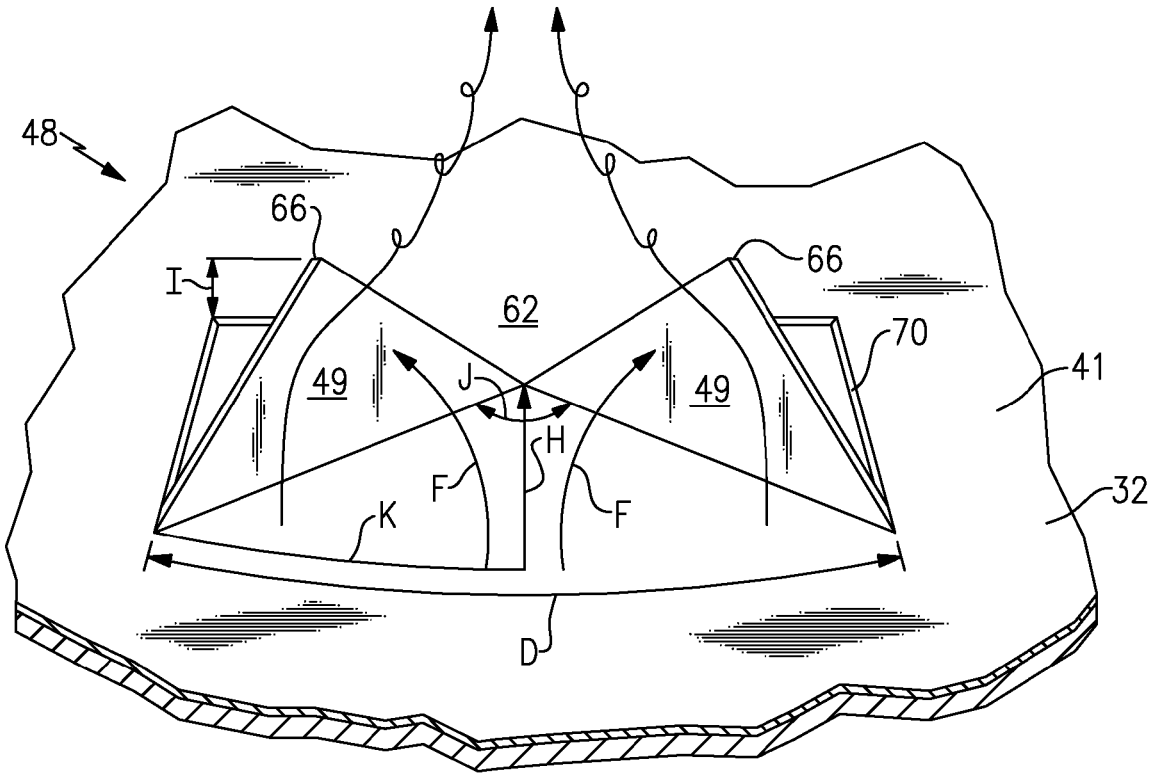
FIG. 10 is a downstream elevational view taken along line 10-10 of FIG. 4, illustrating an exemplary mushroom vortex generating duplex tab obstacle mounted in the improved pulse detonation combustor.

Similarly, in an embodiment illustrated in FIGS. 9 and 10, a mushroom vortex generating duplex tab obstacle is described. More specifically, as illustrated in FIGS. 9 and 10 the duplex tab obstacles 48 (of which only one is illustrated) are also identical with each other and arranged circumferentially spaced apart with each duplex tab obstacle 48 also having a common center slot 62 therebetween a pair of tab members 49. The pair of tab members 49 of each duplex tab obstacle 48 circumferentially adjoin each other along the inner surface 32 of the detonation chamber 41, with the common center slot 62 extending radially inwardly from the common junction thereof.

Figure 11:
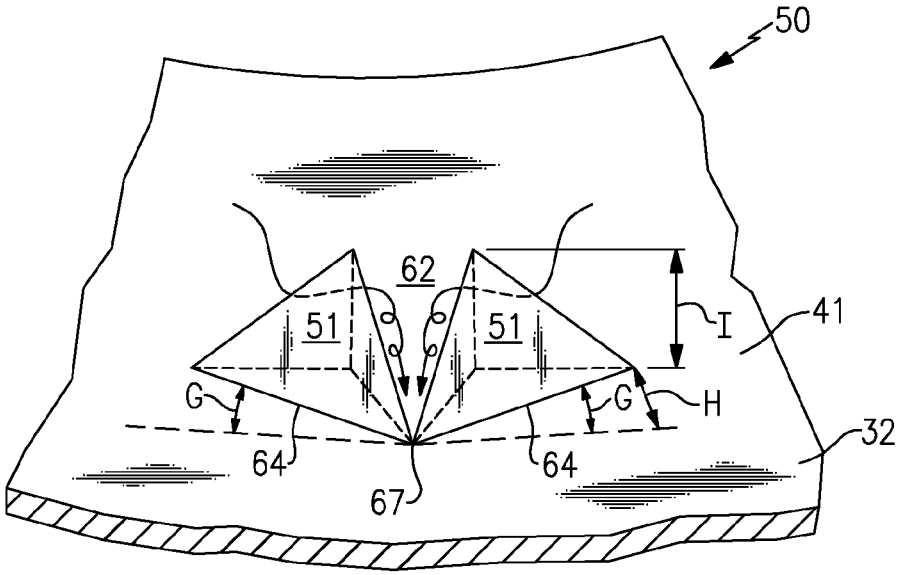
FIG. 11 is an upstream elevational view taken along line 11-11 of FIG. 4, illustrating an exemplary mushroom vortex generating duplex tab obstacle mounted in the improved pulse detonation combustor.
Figure 12:
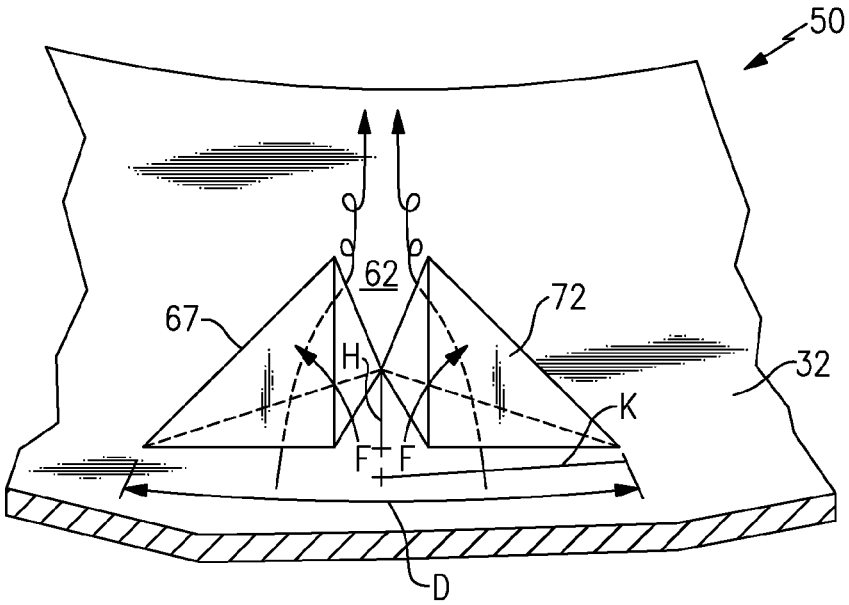
FIG. 12 is a downstream elevational view taken along line 12-12 of FIG. 4, illustrating an exemplary mushroom vortex generating duplex tab obstacle mounted in the improved pulse detonation combustor.

In an embodiment illustrated in FIGS. 11 and 12, a duplex tab obstacle is described that may be configured as either a delta vortex generating duplex tab obstacle or a mushroom vortex generating duplex tab obstacle dependent upon orientation within the pulse detonation chamber 41. More specifically, as illustrated in FIGS. 11 and 12, duplex tab obstacles 50 (of which only one is illustrated) are identical with each other and arranged circumferentially spaced apart with each duplex tab obstacle 50 having a common center slot 62 therebetween a pair of tab members 51. The pair of tab members 51 of each duplex tab obstacle 50 circumferentially adjoin each other along the inner surface 32 of the detonation chamber 41, with the common center slot 62 extending radially inwardly from the common junction thereof. In contrast to the embodiments described with regard to FIGS. 7-10, the pair of tab members 51 of each duplex tab obstacle 50 may include a backfill material 72, either formed separate from tabs 51 or formed integral therewith, so as to form a solid duplex tab obstacle structure, that may optionally include a void formed therein an interior space.

As shown in FIGS. 8, 10 and 12, each pair of tabs 47, 49, 51 has a collective circumferential tab width "D", the corresponding duplex tab obstacles 46, 48, 50 being circumferentially spaced apart from each other at a circumferential spacing "B" as previously described, which is substantially lesser or greater than the corresponding tab width "D" dependent upon engine and chamber 41 design.

The duplex tab obstacles 46, 48, 50 have compound radial and circumferential inclination being inclined downstream both radially and circumferentially toward the outlet 44 of the pulse detonation chamber 41. As shown in FIGS. 7, 10 and 12, the corresponding duplex tab obstacles 46, 48, 50 and more particularly each pair of tabs 47, 49, 51 are inclined radially inwardly at an acute radial inclination or penetration angle "F", also referred to as angle of attack, to provide ramps. The duplex tab obstacles 46, 48, 50 and more particularly each pair of tabs 47, 49, 51 are also circumferentially inclined at an acute skew angle "G", also referred to as sweep angle, forwardly from the outlet 44 of the pulse detonation chamber 41.

The tabs 47, 49 51 of the duplex tab obstacles 46, 48 50 are inclined radially inwardly at the penetration angle "F" to define the maximum penetration, or radial, height "I" of the duplex tab obstacles 46, 48 50 into the pulse detonation chamber 41. The penetration angle "F" may be selected by suitable testing to enhance a turbulence fluid flow and thus the deflagration-to-detonation transition (DDT) while minimizing pressure or performance losses. In the different embodiments of the duplex tab obstacles 46, 48 50 illustrated in FIGS. 7, 10 and 12, the penetration angle "F" is less than 90 degrees from the surface 50, and may be down to about 30 degrees. It may be desirable to minimize the width of the common center slots 62 to alter the streamwise counter-rotating vortices. Decreasing the penetration angle "F" will correspondingly reduce the width of the common center slots 62.

In the illustrated exemplary embodiments, the duplex tab obstacles 46, 48, 50 have a corresponding radially inward fluid stream penetration in the pulse detonation chamber 41. That fluid stream penetration may be defined by the ratio of the penetration depth "I" over the radial height of the chamber 41. The fluid stream penetration is controlled by the size of the duplex tab obstacles 46, 48, 50 their penetration angles "F", radial height "I" and acute skew angle "G". In exemplary embodiments tested, the penetration ratio may be up to about I/R=0.2 where R is the radius of the pulse detonation chamber 41.

The skew, or sweep, angle "G" may also be selected for enhancing the deflagration-to-detonation transition (DDT) while minimizing pressure or performance losses, and in the embodiments illustrated in FIGS. 7-12, has an exemplary value of 45 degrees.

The duplex tab obstacles 46, 48, 50 illustrated in FIGS. 7-12, and more particularly the pair of tabs 47, 49, 51 share similar tab roots 64 disposed along the inner surface 32 of the pulse detonation chamber 41 and are preferably coextensive therewith. The tabs 47, 49, 51 of each duplex tab obstacles 46, 48, 50 are inclined radially inwardly and axially downstream from the corresponding roots 64 thereof to a respective apex 66.

As shown in FIGS. 7, 9 and 11, the tab root 64 may be inclined circumferentially in a forwardly direction from the outlet 44 at the corresponding skew, or sweep, angle "G". The roots therefore extend axially downstream and define a maximum axial length "H" of the individual tabs 47, 49, 51.

The vortex generating parameters may change with axial location and thus may be optimized along the length of the combustor chamber. For example, the circumferential width "D", penetration angle "F", skew angle "G", axial length "H", and corresponding penetration depth "I" may be selected during engine development for enhancing the turbulence of the fluid flow and thus deflagration-to-detonation transition (DDT) while minimizing pressure losses that result in performance loss.

The deflagration-to-detonation transition (DDT) is effected by the generation of the streamwise counter-rotating vortices shown schematically in corresponding pairs in FIGS. 7-12 which enhances the turbulence of the fluid flow within the pulse detonation chamber 41. More particularly, the duplex tab obstacles 46, 48 and 50 generate counter-rotating vortices that work together to create a single strong jet, or fluid flow, between the pairs of tabs 47, 49, 51 of each duplex tab obstacle 46, 48, 50. In addition, the vortices work independently to create individual jets on the outside, or between adjacent duplex tab obstacles 46, 48, 50.

The duplex tab obstacles 46, 48, 50 may have various embodiments for various advantages in meeting the goals of enhancing deflagration-to-detonation transition (DDT) while minimizing performance loss. For example, each of the tabs 47, 49, 51 of the duplex tab obstacles 46, 48, 50 is preferably triangular in one embodiment and formed of relatively thin and of a constant thickness sheet metal having sufficient strength for withstanding the aerodynamic pressure loading thereon during operation in the pulse detonation chamber 41. Each triangular tab 47, 49, 51 therefore defines an inclined delta wing for generating corresponding vortices in the high velocity fluid flow thereover during operation. In the embodiments illustrated, the common center slot 62 between pairs of tabs 47, 49, 51 is also triangular and extends outwardly from the common junction of the corresponding tab roots 64. The fluid flow is therefore impeded by the individual pair of tabs 47, 49, 51 and more particularly the duplex tab obstacles 46, 48, 50 themselves while freely flowing around the triangular perimeters thereof and through the common center slots 62. In the embodiment illustrated in FIGS. 11 and 12, when configured as the illustrated mushroom vortex generating solid duplex tab obstacle, the solid tab structure forms an obstacle that causes the fluid flow to be impeded and forced about a perimeter of the solid tab structure. Similarly, when the embodiment of FIGS. 11 and 12 is configured as a delta vortex generating solid duplex tab obstacle, the solid tab structure provides for the free flow of the fluid flow around a triangular perimeter of the solid tab structure.

In the preferred embodiments illustrated in FIGS. 7-12, the duplex tab obstacles 46, 48, 50 are identical in size and configuration in each row. In the illustrated embodiments, the duplex tab obstacles 46, 48, 50 are symmetrical about the common center slots 62 between each pair of tabs 47, 49, 51 for promoting symmetrical vortices therefrom. The duplex tab obstacles 46, 48, 50 in the different embodiments have different orientations or skew to effect correspondingly different performance. For example, each of the plurality of duplex tab obstacles 46, and more particularly each pair of tabs 47, in the delta vortex generating embodiment described with regard to FIG. 3 and illustrated in FIGS. 7 and 8, diverge apart from the common center slot 62 thereof axially downstream toward the outlet 44 of the pulse detonation chamber 41. Each of the pair of tabs 47 are oriented perpendicular or normal to each other at the intersecting roots 64 thereof and therefore have a 90 degree included angle "J". In FIG. 7, the 90 degree included angle "J" between the pair of tabs 47 faces axially downstream to create a base triangle facing forwardly or upstream, with leading edges of the pair of tabs 47 bounding the forwardly located center slots 62 shown in FIG. 8. The corresponding skew angle "G" is therefore 45 degrees downstream from the outlet 44 from a common center junction 67 of the two roots 64. In this configuration, the duplex tab obstacles 46, and more specifically each tab of the pair of tabs 47, individually define triangular delta wing pairs, and are collectively arranged in an upstream facing or pointing chevron or double-deltoid profile having downstream-diverging wings.

In contrast, the duplex tab obstacles 48, 50 and more particularly each of the pairs of tab 49, 51 for the pulse detonation chamber embodiments described with regard to FIG. 4, and illustrated in FIGS. 9-12 circumferentially converge together in the axially downstream direction toward the common center slot 62 or common center junction 67. In the embodiment, the pairs of tabs 49, 51 are again normal or perpendicular to each other at the intersecting roots 64 at a 90 degree included angle "J". Correspondingly, the skew angles "G" are again 45 degrees axially downstream from the outlet 44. In FIGS. 10 and 12, the 90 degree included angle "J" of the each of the pair of tabs 49, 51 faces axially forwardly to define a base triangle projecting axially downstream, with the center slot 62 being bound by downstream edges of each tab in the pair of tabs 49, 51. In this configuration, the pair of tabs 49, 51 again more specifically each tab of the pair of tabs 49, 51 individually define triangular delta wings, but are collectively arranged in a downstream facing or pointing chevron or double-deltoid profile having downstream-converging wings, with the pair of tab members 49, 51 spreading laterally in mushroom fashion to an downstream junction point 67.

Although the mushroom and delta configurations of the duplex tab obstacles 46, 48, 50 share common features and ability to promote enhanced mixing of the corresponding flow streams, the configurations also effect different performance. For example, the pairs of streamwise counter-rotating vortices generated by these different configurations, while rotating opposite relative to each other, will create differing jets along surface 32 of the pulse detonation chamber 41.

The improved detonation chamber 41 may be constructed in a variety of ways. In the embodiments illustrated in FIGS. 7-12 the duplex tab obstacles 46, 48, 50 have a common axial length "H", and the collective width "K" thereof is substantially twice the length "H". This configuration has additional advantages during the fabrication of the duplex tab obstacles 46, 48, 50. In an exemplary embodiment, a piece of sheet metal is shaped to include the plurality of duplex tab obstacles 46, 48, 50. For example, the tab pairs 47 in FIGS. 7 and 8 and the tab pairs 49 in FIGS. 9 and 10 may be initially formed from a common piece of sheet metal slit and bent to shape. As best illustrated in FIGS. 7 and 8, a middle slit 68 of axial length "H" and a circumferential slit 69 of circumferential length "D" may be cut at circumferential spacing "A" therebetween to provide a rectangular perimeter. The pair of tab members 47 may be bent from the corresponding roots 64 within the bounding rectangular perimeter to the desired penetration angle "F". As best illustrated in FIGS. 9 and 10, alternatively two end slits 70 of axial length "H" and a circumferential slit 69 of circumferential length "D" may be cut at a circumferential spacing "A" therebetween to provide a rectangular perimeter. The pair of tab members 49 may then be bent from their corresponding roots 64 to achieve the desired penetration angles "F". In an exemplary embodiment, subsequent to forming the duplex tab obstacles 46, 48 the piece of sheet metal may then be rolled to form the inner surface 32 of the improved detonation chamber 41. The improved detonation chamber 41 may also be formed through several other methods including, but not limited to, casting, welding or molding tabs 46 and 46.

In the embodiment illustrated in FIGS. 11 and 12, the pair of tabs 51 may be formed similar to tabs 46 and 48 as best described above with reference to FIGS. 7-10. More specifically, the pair of tabs 51 may be formed as previously detailed with regard to tabs 46 and 48 with the addition of the backfill material 72, thereby forming the solid shaped structure protruding from a surface 32 of the pulse detonation chamber 41. In an embodiment, the pair of tabs 51 may be formed by machining the pair of tabs 51 and backfill material 72 as a solid structure into the detonation chamber 41 wall, such as by integrally machining the solid structure into the surface 32 of the detonation chamber or machining the pair of tabs 51 as inserts that may be subsequently positioned within an opening formed in the detonation chamber 41 wall or surface 32. In yet an alternate embodiment of FIGS. 11 and 12, the pair of tabs 51 may be formed by stamping, casting, welding, molding, or the like, to form the solid shaped structure protruding from the surface 32 of the detonation chamber 41.

The duplex tab obstacles 46, 48, 50 may have various possible configurations within the pulse detonation chamber 41, further including odd as well as even numbers thereof; unequal as well as equal circumferential spacing; and unequal as well as equal size, geometry, and position of the duplex tab obstacles 46, 48, 50 around the inner surface 32 of the pulse detonation chamber 41 as desired to enhance deflagration-to-detonation transition (DDT) while minimizing aerodynamic performance losses.

Figure 13:
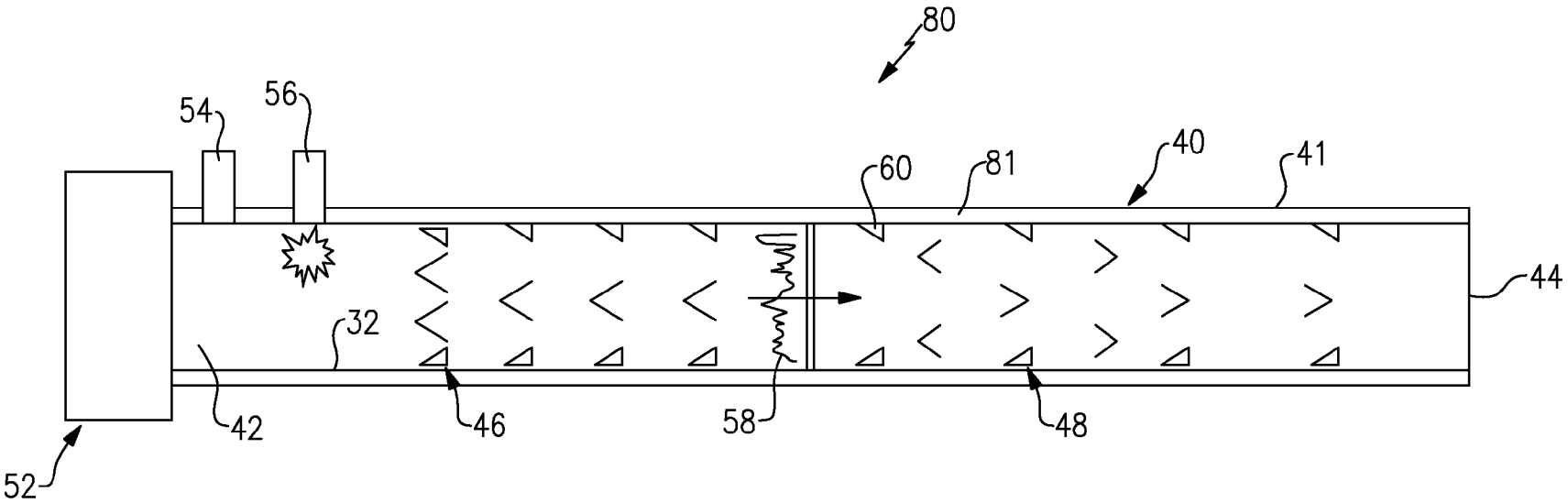
FIG. 13 is a diagram illustrating an improved pulse detonation combustor including duplex tab obstacles for deflagration-to-detonation transition enhancement in accordance with exemplary embodiments.

Referring now to FIG. 13, illustrated is a pulse detonation combustor 80, including different configurations of the duplex tab obstacles. More particularly illustrated are duplex tab obstacles 46, 48, 50 which may be alternatively used in combination and at the different locations within a pulse detonation chamber 81, generally similar to detonation chamber 41, in order to optimize performance during various stages of the deflagration-to-detonation runup process. During operation, the DDT process, and more particularly the detonation wave 58, progresses down the axial length of the pulse detonation chamber 81. Due to this progression, the optimized vortex generating parameters may change with axial location. For example, whereas it may be found that delta vortex generators, such as those described as duplex tab obstacles 46, or duplex tab obstacles 50 when configured as a delta vortex generator, are more effective during the initial stages of DDT and therefore disposed in an upstream portion of the pulse detonation chamber 81, it may also be found that mushroom vortex generators, such as those described as duplex tab obstacles 48, or duplex tab obstacles 50 when configured as a mushroom vortex generator, are more effective during the later stages, and therefore disposed in a downstream portion of the pulse detonation chamber 81. As previously described with regard to the embodiments illustrated in FIGS. 3 and 4, the vortex generator parameters can vary along the length of the pulse detonation chamber 41 and may include the type of vortex generator (i.e. delta vortex generator or mushroom vortex generator), penetration height "I", skew or sweep angle "G", penetration angle or angle of attack "F", number of vortex generators or duplex tab obstacles 46, 48, 50 in each circumferential array 60, axial spacing "A" between each array 60, and relative clocking angle "C" of one circumferential arrays 60 relative to another circumferential array 60.

These various configurations are shown in the Figures as an expedient of presentation only, and actual use of the various duplex tab obstacles 46, 48, 50 will depend on actual combustor design and aerodynamic cycles. As previously indicated, both the radial penetration angle "F" and the circumferential skew angle "G" can be varied to maximize performance, with a larger skew angle "G" correspondingly narrowing the circumferential width "D" of the duplex tab obstacles 46, 48, 50 and reducing their flow obstruction.

Furthermore, the duplex tabs can also be used in conjunction with other commonly used DDT geometries that are available in the prior art (such as spirals, regularly spaced blockage plates)

A minimum circumferential spacing between the tabs 47, 49, 51 in each pair at their bases or roots 64 may be up to about twice the circumferential width of each tab for maintaining the aerodynamic cooperation of the pair of counter-rotating vortices shed from the tab pairs.

In the exemplary embodiments illustrated in the Figures, the duplex tab obstacles 46, 48, 50 are axially symmetrical, and converge from the roots 64 to the apexes 66, which apexes may be relatively sharp with small radius bullnoses. In alternate embodiments, the duplex tab obstacles may be truncated in radial penetration at the apexes, which apexes provide flat chords in the correspondingly truncated triangular, or trapezoidal, configurations.

The various individual tabs in the pairs of tabs 47, 49, 51 illustrated in FIGS. 7-12 include two lateral edges each, one providing a leading end over which the fluid first flows, and the other edge providing a trailing end over which the fluid flow is shed in the cooperating vortices around the common center slot 62 therebetween. In alternate embodiments, the triangular profiles of the individual tabs may be further modified to include nonsymmetrical configurations in which the lengths of the leading and trailing ends may be varied as required for best cooperating with the aerodynamic variations in fluid flow within the pulse detonation chamber.

Accordingly, by the introduction of relatively simple and small duplex tab obstacles on an interior surface of the pulse detonation chamber, between the inlet and the outlet, significant enhancement in the turbulence of the fluid flow within the detonation chamber, and in turn enhancement of the deflagration-to-detonation transition may be obtained with relatively small pressure loss. The duplex tab obstacles may have various configurations represented by various permutations of the various features described above as examples.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A detonation chamber for a pulse detonation combustor comprising:

a plurality of duplex tab obstacles disposed on at least a portion of an inner surface of the detonation chamber, wherein each of the plurality of duplex tab obstacles are comprised of at least a pair of tabs wherein each tab of said pair of tabs are triangular and define an inclined delta wing protruding from the inner surface of the detonation chamber so as to provide for a free flow of fluid around a triangular perimeter and between an underneath surface of each of the tabs and the inner surface of the detonation chamber, each of the pair of tabs having a common center slot circumferentially between adjacent pairs of tabs and defining a plurality of circumferential and axially spaced apart duplex tab obstacles, wherein the plurality of duplex tab obstacles have compound radial and circumferential inclination therein from the tab root to the tab apex and between forward and aft edges and wherein one of the forward and aft edges meet the inner surface of the detonation chamber at an angle of less than 90 degrees, said common center slot being triangular and extending outwardly from a common junction of said tab roots and diverging circumferentially therebetween, wherein the plurality of duplex tab obstacles enhance a turbulence of a fluid flow and flame acceleration through the detonation chamber.

2. The detonation chamber of claim 1, further comprising an inlet and an outlet, wherein the plurality of duplex tab obstacles are disposed on at least a portion of an inner surface of the detonation chamber between the inlet and the outlet.

3. The detonation chamber of claim 2, wherein said pair of tabs is symmetrical about said common center slot therebetween.

4. The detonation chamber of claim 2, wherein said circumferential and axially spaced apart duplex tab obstacles are disposed in one or more circumferential arrays axially spaced along at least a portion of the inner surface of the detonation chamber.

5. The detonation chamber of claim 4, wherein said circumferential and axially spaced apart duplex tab obstacles are uniformly spaced within each circumferential array.

6. The detonation chamber of claim 4, wherein the one or more circumferential arrays are equally spaced axially along at least a portion of the inner surface of the detonation chamber.

7. The detonation chamber of claim 2, wherein said pair of tabs of each of said duplex tab obstacles are inclined both radially and circumferentially relative to said outlet of said pulse detonation chamber.

8. The detonation chamber of claim 7, wherein each duplex tab obstacle includes a pair of circumferentially inclined roots along said inner surface of said pulse detonation chamber and wherein each root is inclined radially from said root to an apex of said duplex tab obstacle.

9. The detonation chamber of claim 8, wherein said pair of tabs of each duplex tab obstacle circumferentially diverge toward said outlet of said pulse detonation chamber.

10. The detonation chamber of claim 8, wherein said pair of tabs of each duplex tab obstacle circumferentially converge toward said outlet of said pulse detonation chamber.

11. A detonation chamber for a pulse detonation combustor comprising:

a plurality of duplex tab obstacles disposed on at least a portion of an inner surface of the detonation chamber wherein the plurality of duplex tab obstacles have compound radial and circumferential inclination therein from a tab root to a tab apex and between forward and aft edges, said compound radial and circumferential inclination configured to enhance a turbulence of a fluid flow and flame acceleration through the detonation chamber, and wherein each of the plurality of duplex tab obstacles include at least a pair of tabs, wherein each tab of said pair of tabs are triangular and define an inclined delta wing protruding from the inner surface of the detonation chamber so as to provide for a free flow of fluid around a triangular perimeter and between an underneath surface of each of the tabs and the inner surface of the detonation chamber wherein one of the forward and aft edges meet the inner surface of the detonation chamber at an angle of less than 90 degrees, each of the pair of tabs having a common center slot circumferentially between adjacent pairs of tabs and defining a plurality of circumferential and axially spaced apart duplex tab obstacles, said common center slot being triangular and extending outwardly from a common junction of said tab roots and diverging circumferentially therebetween; and an inlet and an outlet, wherein the plurality of duplex tab obstacles are disposed on at least a portion of an inner surface of the detonation chamber between the inlet and the outlet.

12. The detonation chamber of claim 11, wherein the plurality of duplex tab obstacles are disposed in one or more circumferential arrays axially spaced along at least a portion of the inner surface of the detonation chamber.

13. The detonation chamber of claim 12, wherein the pair of tabs of each of said duplex tab obstacles includes a root circumferentially inclined forwardly from said outlet and an apex spaced radially from said root.

14. The detonation chamber of claim 11, wherein said pair of tabs circumferentially converge toward said common center slot toward said outlet.

15. The detonation chamber of claim 11, wherein said pair of tabs circumferentially diverge toward said common center slot toward said outlet.

16. A pulse detonation combustor comprising:

at least one detonation chamber;

an oxidizer supply section for feeding an oxidizer into the detonation chamber;

a fuel supply section for feeding a fuel into the detonation chamber; and an igniter for igniting a mixture of the gas and the fuel in the detonation chamber, wherein said detonation chamber comprises a plurality of duplex tab obstacles disposed on an inner surface of the detonation chamber, wherein each of the plurality of duplex tab obstacles are comprised of at least a pair of tabs wherein each tab of said pair of tabs are triangular and define an inclined delta wing protruding from the inner surface of the detonation chamber and having a maximum radially height of 10% or less than 50% of the detonation chamber so as to provide for a free flow of fluid around a triangular perimeter and between an underneath surface of each of the tabs and the inner surface of the detonation chamber, each of the pair of tabs having a common center slot circumferentially between adjacent pairs of tabs and defining a plurality of circumferential and axially spaced apart duplex tab obstacles, wherein the plurality of duplex tab obstacles have compound radial and circumferential inclination therein from the tab root to the tab apex and between forward and aft edges wherein the plurality of duplex tab obstacles have compound radial and circumferential inclination therein from the tab root to the tab apex and between forward and aft edges and wherein one of the forward and aft edges meet the inner surface of the detonation chamber at an angle of less than 90 degrees, with said common center slot being triangular and extending outwardly from a common junction of said tab roots and diverging circumferentially therebetween, and wherein the plurality of duplex tab obstacles enhance a turbulence of a fluid flow and flame acceleration through the detonation chamber.

17. The pulse detonation combustor of claim 16, wherein the detonation chamber further comprises an inlet and an outlet, wherein the plurality of duplex tab obstacles are disposed between the inlet and the outlet.

18. The pulse detonation combustor of claim 16, wherein the plurality of duplex tab obstacles are circumferentially and axial spaced apart between said inlet and said outlet.

19. The pulse detonation combustor of claim 16, wherein the circumferential spaced apart plurality of duplex tab obstacles are disposed in one or more circumferential arrays axially spaced along at least a portion of the inner surface of the detonation chamber.

20. The pulse detonation combustor of claim 16, wherein said duplex tab obstacles are inclined both radially and circumferentially toward said outlet of said pulse detonation chamber.

* * * * *